US006047818A

United States Patent [19]

Warby et al.

[11] Patent Number: 6,047,818

[45] **Date of Patent: *Apr. 11, 2000**

[54] DUAL COMPONENT DISPENSING APPARATUS

[75] Inventors: Richard John Warby, Wisbech, United Kingdom; Miro Stan Cater, Daytona Beach, Fla.

[73] Assignee: BESPAK plc, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/860,490

[22] PCT Filed: Feb. 20, 1996

[86] PCT No.: PCT/GB96/00376

§ 371 Date: Oct. 29, 1997

§ 102(e) Date: Oct. 29, 1997

[87] PCT Pub. No.: WO96/26126

PCT Pub. Date: Aug. 29, 1996

[30] Foreign Application Priority Data

Feb. 21, 1995 [GB] United Kingdom ..... 9503426

[51] Int. Cl.[7] ..... B65D 81/32

[52] U.S. Cl. ..... 206/221; 206/219; 206/568; 215/DIG. 8

[58] Field of Search ..... 206/219–222; 215/6, 10, 227, 258, 329, DIG. 8

[56] References Cited

U.S. PATENT DOCUMENTS

| | | | |
|---|---|---|---|
| 3,255,926 | 6/1966 | Modderno | 206/221 |
| 4,132,308 | 1/1979 | Goncalves . | |
| 4,386,696 | 6/1983 | Goncalves . | |
| 4,591,050 | 5/1986 | Finke et al. | 215/DIG. 8 |
| 4,618,444 | 10/1986 | Hudson et al. | 206/219 |
| 4,720,351 | 1/1988 | Flynn et al. | 206/568 |
| 4,793,475 | 12/1988 | Itzel . | |
| 4,875,577 | 10/1989 | Hildebrandt et al. . | |
| 4,903,828 | 2/1990 | Finke et al. . | |
| 5,811,060 | 9/1998 | Valderrama | 215/DIG. 8 |

FOREIGN PATENT DOCUMENTS

| | | |
|---|---|---|
| 0190593 | 2/1986 | European Pat. Off. . |
| 0259852 | 9/1987 | European Pat. Off. . |
| 8624484 | 2/1988 | Germany . |
| 8624487 | 2/1988 | Germany . |

*Primary Examiner*—Paul T. Sewell
*Assistant Examiner*—Luan K. Bui
*Attorney, Agent, or Firm*—Smith, Gambrell & Russell, LLP

[57] ABSTRACT

This invention relates to apparatus for separately storing and subsequently mixing two components of a substance to be dispensed. The invention therefore comprises apparatus for separately storing and subsequently mixing first and second components of a substance to be dispensed, the apparatus comprising a container (2) defining a chamber (3) for receiving the first component (4), a closure member (6) connected to the container to close an outlet of the container, a vial (7) comprising a first portion (8) formed integrally with the closure member (6) and a second portion (9) releasably connected in sealing engagement with the first portion (8) to define therebetween a compartment (11) for receiving the second component (12), and vial opening means actuatable by movement of the closure member relative to the container to move the second portion out of sealing engagement with the first portion to thereby establish comunication between the chamber and the compartment for mixing of the first and second components.

12 Claims, 8 Drawing Sheets

DUAL COMPONENT DISPENSING APPARATUS

This invention relates to apparatus for separately storing and subsequently mixing two components of a substance to be dispensed.

Dual component dispensers for pharmaceutical, cosmetic and other fluid preparations typically comprise a chamber receiving a liquid and a separate compartment for a powder or liquid which is required to be separately stored until immediately prior to use of the mixture, this being particularly necessary where the mixture degrades rapidly with age.

Some known arrangements rely upon a seal being penetrated by a needle to initiate mixing, such arrangements being complex and requiring assembly from numerous components.

It is also known from U.S. Pat. No. 4,614,267 to provide a vial which can be manually opened by manipulation through the sides of a flexible container within which it extends. Such an arrangement is however unsuitable to most applications where rigid or semi-rigid containers are required.

DE-U-8624484 describes a dual component dispenser having a rotatable cap to which is joined a cylindrical inner container for receiving one substance. Co-operating projections on the rotatable cap and the inner container provide mutual locking between those two components. Further co-operating projections on the inner container and an outer container in which the inner container is located limit the extent of relative rotation between the inner container and the outer container. Thus when the cap is rotated, after an initial period of rotation of the inner container relative to the outer container, further rotational movement is prevented and the cam action between the projections on the cap and on the inner container cause the inner container to be sheared downwards. The inner container falls into the oater container allowing the substances contained in the two containers to be mixed.

According to the present invention there is disclosed apparatus for separately storing and subsequently mixing first and second components of a substance to be dispensed, the apparatus comprising a container defining a chamber for receiving the first component, a closure member rotatably mounted about a tubular neck of the container to close an outlet of the container defined by said neck, a vial comprising a first portion formed integrally with the closure member and a second portion releasably connected in sealing engagement with the first portion to define therebetween a compartment for receiving the second component, and vial opening means comprising cooperating cam formations on the closure member and the second portion of the vial actuatable by co-axial rotational movement of the closure member about the container neck to move the second portion out of sealing engagement with the first portion to thereby establish communication between the chamber and the compartment for mixing of the first and second components, characterised in that the cam formations comprise a helical cam surface defined by a projection of the closure member and a co-operating cam member of the second portion of the vial, and means are provided on the internal wall of the container and co-operating with the cam member to prevent rotation of the second portion relative to the container during opening such that-rotational movement of the closure member displaces the cam member axially in a direction away from the first portion of the vial.

An advantage of such an arrangement is that the user may readily open the vial to promote mixing of the first and second components simply by external manipulation of the closure member and container so that the container may be rigid or semi-rigid in construction. A further advantage is that the apparatus is assembled from a limited number of components and is therefore relatively inexpensive to manufacture and simple to assemble.

Conveniently the second portion of the vial comprises a hollow cylindrical body and the cam member projects radially therefore.

Preferably the cam member if resiliently biased into contact with the rotation preventing means provided by ratchet formations.

An advantage of this arrangement is to allow the closure member to be screwed into sealing engagement with the neck by rotation of the closure member without resulting in any relative movement between the first and second portions of the vial, thereby maintaining the seal formed between the first and second portions, and accommodating relative movement between the cam member and the internal wall by action of the ratchet formations.

Preferably the cam formations comprise a pair of like cam surfaces diametrically opposed relative to the circumference of the closure member and a co-operating pair of like cam members at locations diametrically opposed relative to the second portion.

The use of such symetrically opposed cam formations avoids twisting or bending moments being applied to the vial as a result of the cam action required to open the vial.

Advantageously the closure member and the neck comprise respective co-operating stop formations operable to limit the relative rotational movement between the closure member and the container in the direction required to actuate the vial opening means. The stop formations may comprise a retaining flange of the closure member co-operating with a retaining rib of the container, the retaining flange comprising a fracturable zone of weakness whereby the retaining flange may be selectively removed to facilitate opening of the container by unscrewing the closure member from the neck.

The first portion of the vial may be formed unitarily with the closure member.

The closure member may comprise a dispensing nozzle defining a nozzle and may be further provided with a cap having a stopper sealingly fitted into the nozzle opening.

The present invention also extends to a closure member incorporating the above described features and usable with a conventional container having a screw threaded neck.

Preferred embodiments of the present invention will now be described by way of example only and with reference to the accompanying drawings of which:

Figure 1:
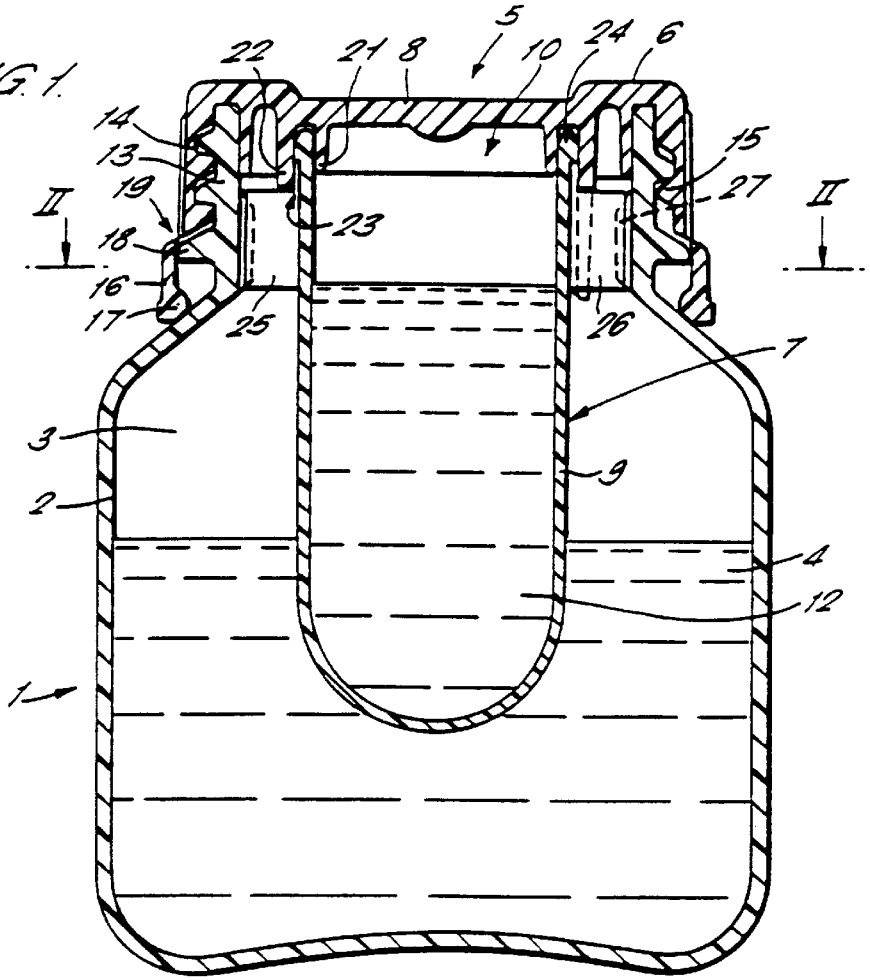
FIG. 1 is a sectioned elevation of an apparatus in accordance with the present invention.
Figure 2:
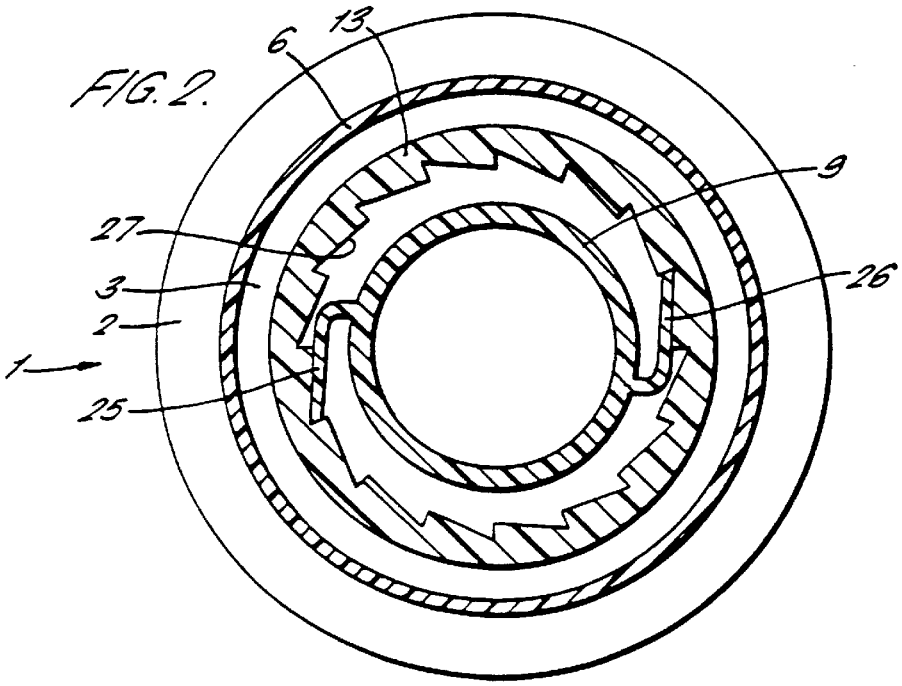
FIG. 2 is a plan view of the apparatus of FIG. 1 sectioned at II—II.

An apparatus 1 shown in FIGS. 1 to 6 consists of a container 2 defining a chamber 3 in which a liquid first component 4 is stored. The container further defines an outlet 5 as seen more clearly in FIG. 6 and which in FIG. 1 is closed by a closure member 6.

The apparatus 1 further comprises a vial 7 of which a first portion 8 is disc shaped and formed unitarily with the closure member 6 and of which a second portion 9 is cylindrical walled and cup shaped with a mouth 10 sealed by the first portion.

The first and second portions 8 and 9 thereby together define a closed compartment 11 in which a liquid second component 12 is stored separately from the first component 4.

The container 2 is bottle shaped and formed of a rigid plastics material having a tubular neck 13 provided with external screw threads 14 engaging in co-operating internal screw threads 15 of the closure member 6. The screw threads 14 and 15 are ramped to allow the closure member 6 to be assembled by axial movement onto the neck, the ramped shape of the screw threads allowing the diameter of the closure member to be momentarily increased by resilient deformation during assembly. Following this axial movement to engage the screw threads 14 and 15, the closure member is then tightened into sealing engagement with the neck 13 by rotation of the closure member in a clockwise direction viewed from above.

The closure member 6 has a depending skirt 16 of enlarged diameter, terminating in a retaining flange 17 which projects radially inwardly of the skirt.

An annular retaining rib 18 projects radially outwardly from the base of the neck 13 to a radial extent greater than the inner radius of the retaining flange 17 so that the retaining flange and the retaining rib co-operate to limit the extent to which the closure member can be unscrewed from the neck.

Figure 3:
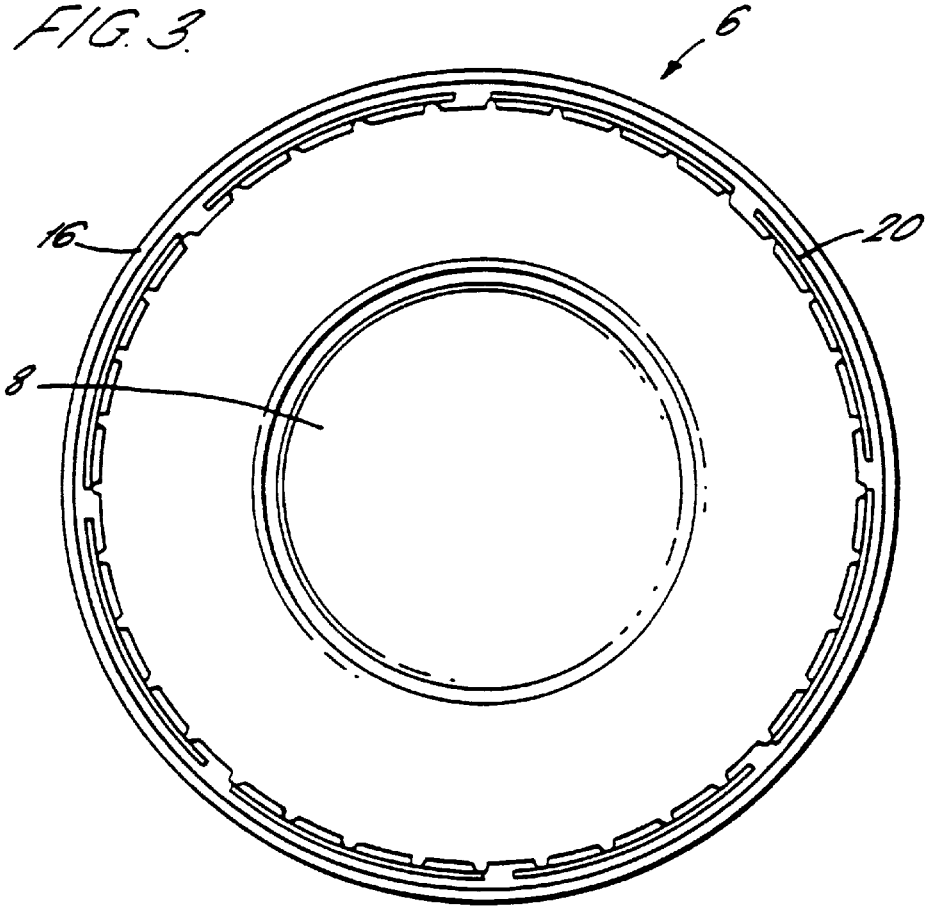
FIG. 3 is a plan view of a closure member of the apparatus of FIG. 1.

The skirt 16 is formed with an annular zone of weakness 19 formed by localised thinning of the plastics material and an interrupted annular slot 20 shown in FIG. 3 whereby the skirt may be detached from the closure member 6 by the user when it is required to completely unscrew the closure member 6 from the neck 13. The zone of weakness 19 is fractured to release the closure member 6 by the application of torque exceeding a threshold value to the closure member in the counter clockwise direction. The fracture of the zone of weakness 19 thereafter serves as a means ot indicating that the container has been opened and necessarily therefore that the components have been mixed.

The closure member 6 further comprises inner and outer tubular members 21 and 22 which project co-axially within the neck 13 into the chamber 3 and so as to define therebetween an annular groove 23 peripheral to the disc consituted by the first portion 8. The second portion 9 of the vial 8 has a rim 24 peripheral to the mouth 10 of the vial and which is received as a push fit within the groove 23 so as to be sealingly retained.

First and second cam members 25 and 26 project tangentially from the second portion 9 at locations immediately adjacent the rim 24 and so as to abut axially the outer tubular member 22. As shown more clearly in FIG. 2, the first and second cam members 25 and 26 consist of web like projections having a shape memory which results in them being resiliently biased outwardly into contact with ratchet formations 27 formed internally on the neck 13, the cam members and ratchet formations co-operating to prevent rotational movement of the second portion 9 of the vial 7 in a counter clockwise direction as seen in plan view in FIG. 2.

Figure 5:
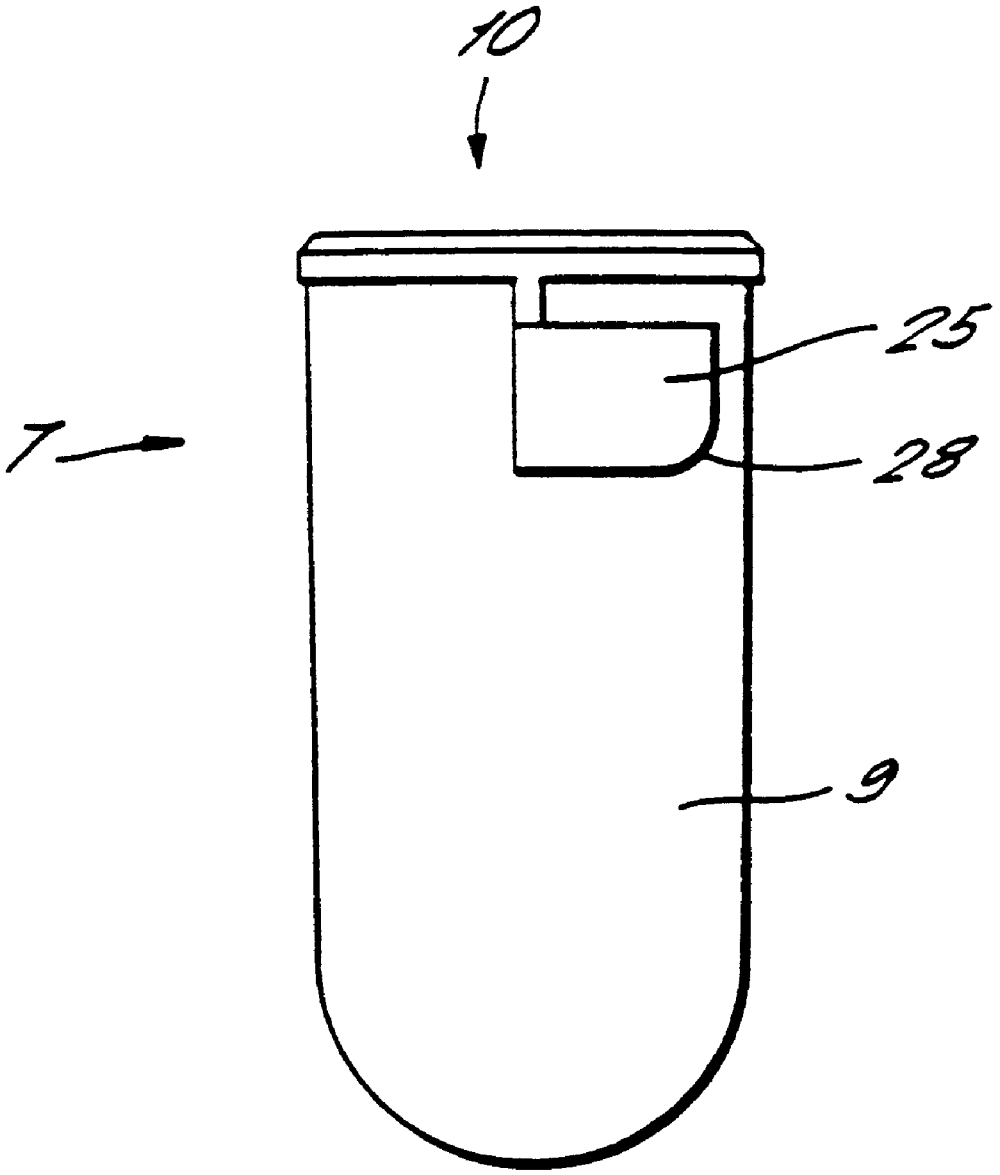
FIG. 5 is an elevation of a vial of the apparatus ot FIG. 1.
Figure 6:
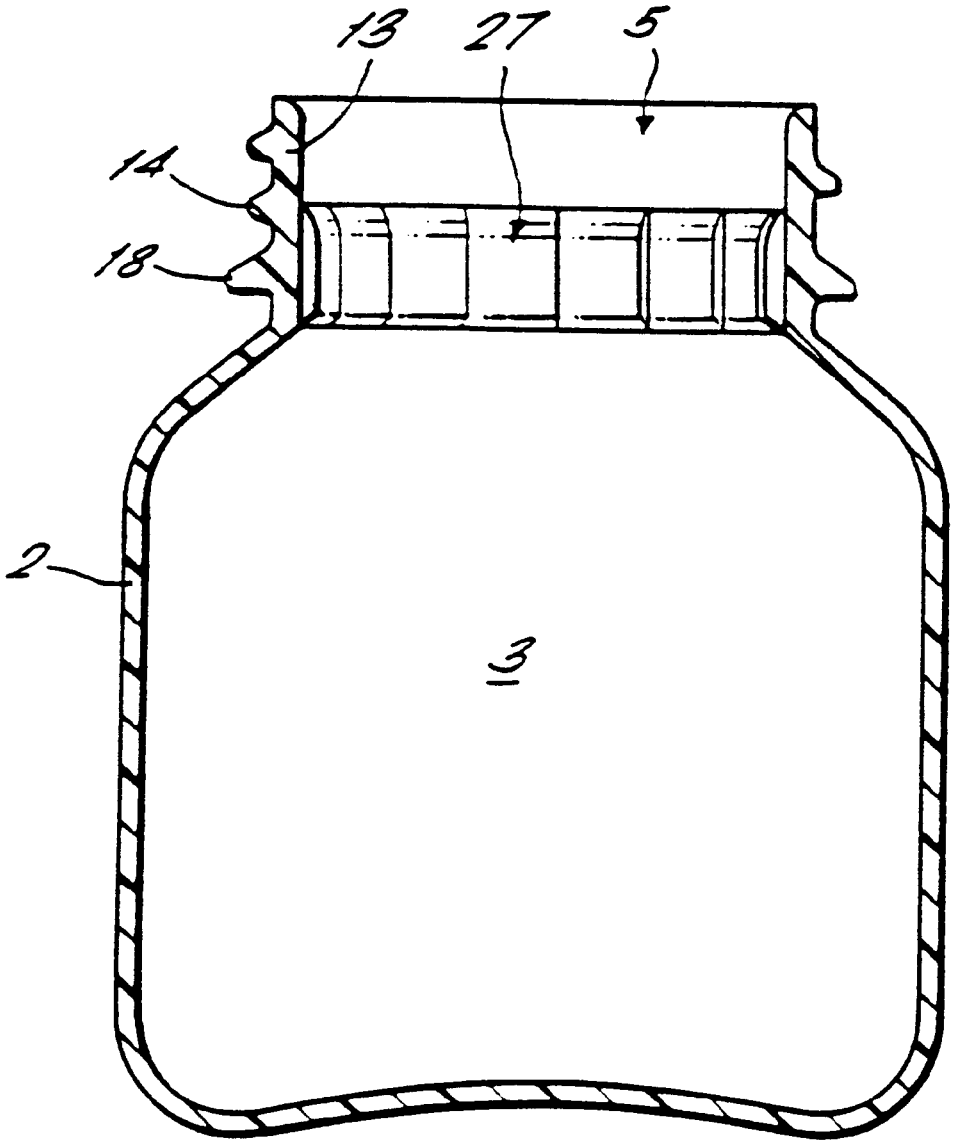
FIG. 6 is a sectioned elevation of a container of the apparatus of FIG. 1.

The shape of the first cam member 25 is shown additionally in FIG. 5 in elevation where it is seen to include a curved leading edge 28 to assist in the process of inserting the vial into the neck 13 during assembly.

Figure 4:
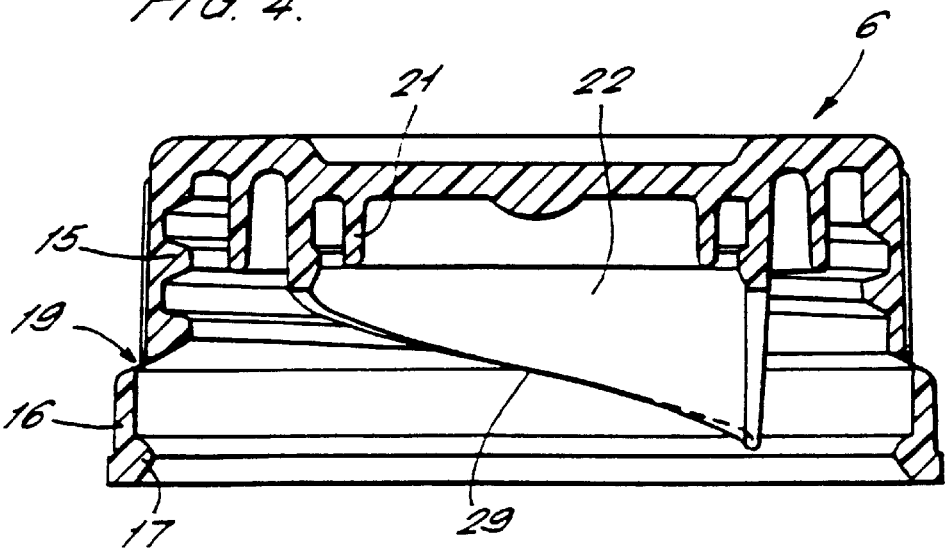
FIG. 4 is a sectioned elevation of the closure member of FIG. 3.

The axial extent of the outer tubular member 22 varies circumferentially as shown in FIG. 4 to define a first helical cam surface 29, a second helical cam surface (not shown) being formed diametrically opposite to the first helical cam surface, whereby the first and second cam members 25 and 26 are engageable by the respective first and second helical cam surfaces when the closure member 6 is rotated counter clockwise relative to the container 2 to thereby induce axial movement of the second portion 9 of the vial 7 in a direction away from the closure member.

During this motion, the second portion 9 moves linearly and axially without rotation relative to the container 2 until ultimately the rim 24 of the second portion 9 becomes disassociated from the groove 23 and the cam members 25 and 26 become dissociated from the ratchet formations 27. The second portion 9 is then free to fall into the chamber 3. The mouth 10 of the vial 7 then communicates with the chamber 3 and the first and second components 4 and 12 are free to mix.

The cam formations constituted by the cam surfaces 29 and the cam members 25,26 thereby constitute vial opening means actuated by the counter clockwise rotation of the closure member relative to the container 2.

A user wishing to dispense the resulting mixture of the first and second components 4 and 12 must then remove the closure member 6 from the neck 13 after having first removed the skirt 16 by fracturing the zone of weakness 19 as described above.

The closure member 6 may be refitted to the neck 13 by screw action.

An alternative apparatus 40 will now be described with reference to FIGS. 7 to 15 using corresponding references to previous Figures where appropriate for corresponding elements.

The apparatus 40 comprises a container 2 of semi-rigid plastics material in the form of a squeeze bottle of the type customarily used for dispensing nasal drops and like substances. The container 2 defines a chamber 3 receiving a liquid first component 4, the container having a neck 13 with external screw threads 14 which co-operate with internal screw threads 15 of a closure member 6.

The closure member 6 has a depending skirt 16 which, unlike the skirt of apparatus 1, is arranged to permanently retain the closure member upon the neck, the skirt 16 having a retaining flange 17 which co-operates with a retaining rib 18 of the neck to limit the extent to which the closure member may be unscrewed from the neck.

The screw threads 14 and 15 are ramped to facilitate assembly of the closure member 6 with the neck 13 by axial movement of the closure member towards the container 2.

Figure 12:
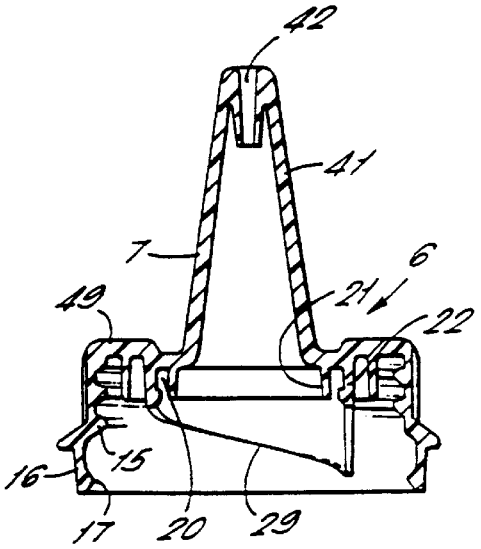
FIG. 12 is a sectioned elevation of the closure member of FIGS. 7 to 11 with the cap removed.
Figure 13:
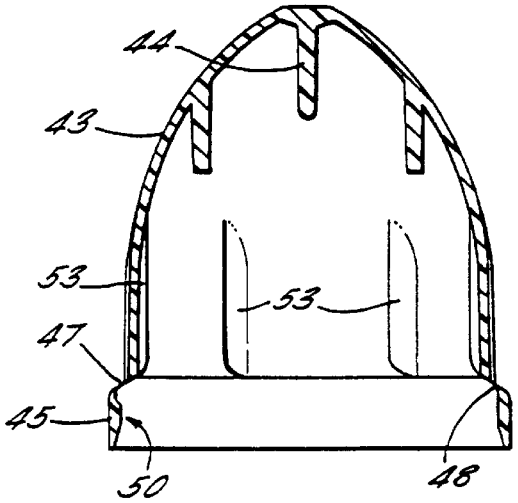
FIG. 13 is a sectioned elevation of the cap of the apparatus of FIGS. 7 to 11.

The closure member 6 includes a generally conically shaped and axially projecting dispensing nozzle 41 which, as shown in FIG. 12, defines a nozzle opening 42.

Figure 7:
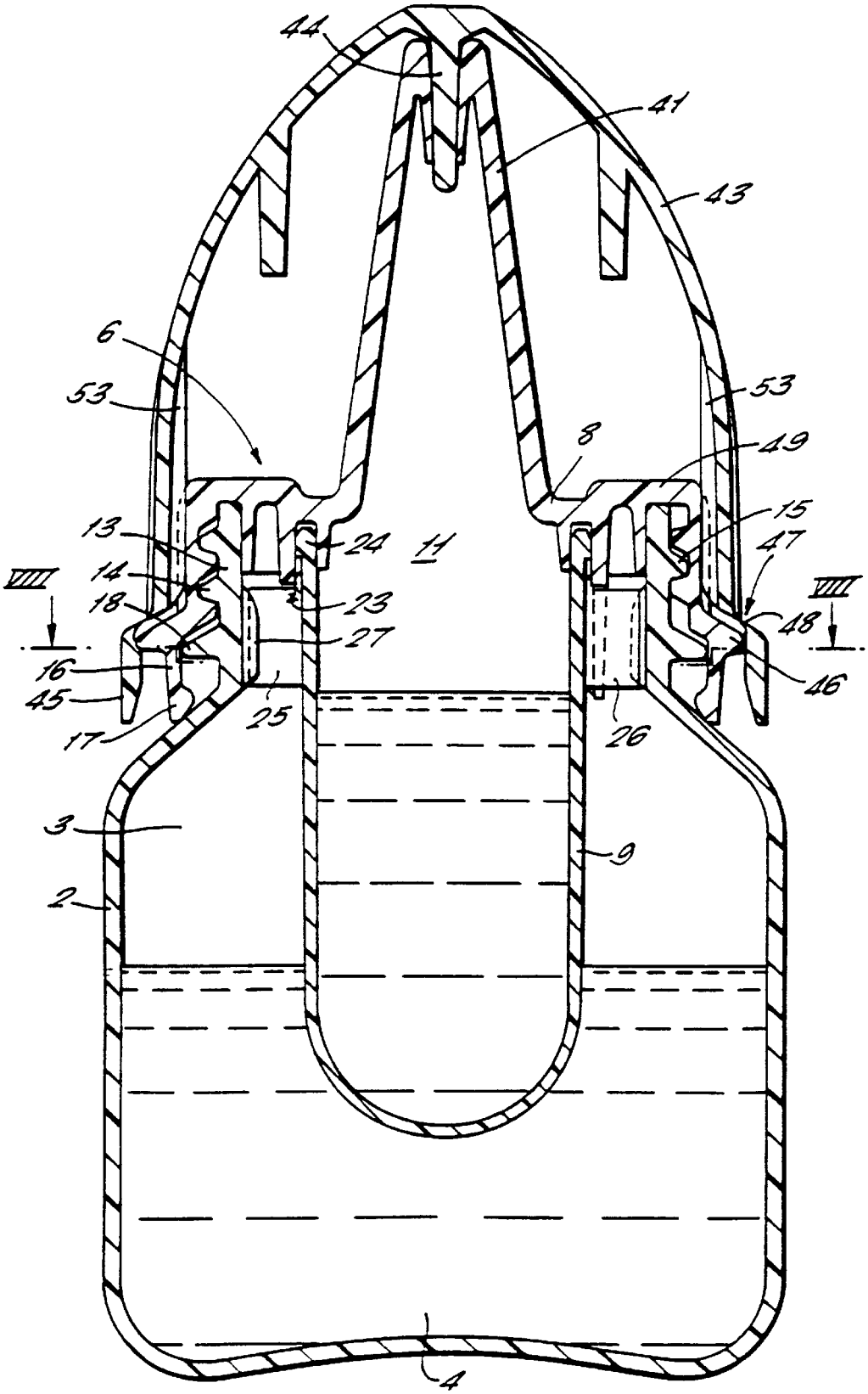
FIG. 7 is a sectioned elevation of an alternative apparatus in accordance with the present invention.
Figure 10:
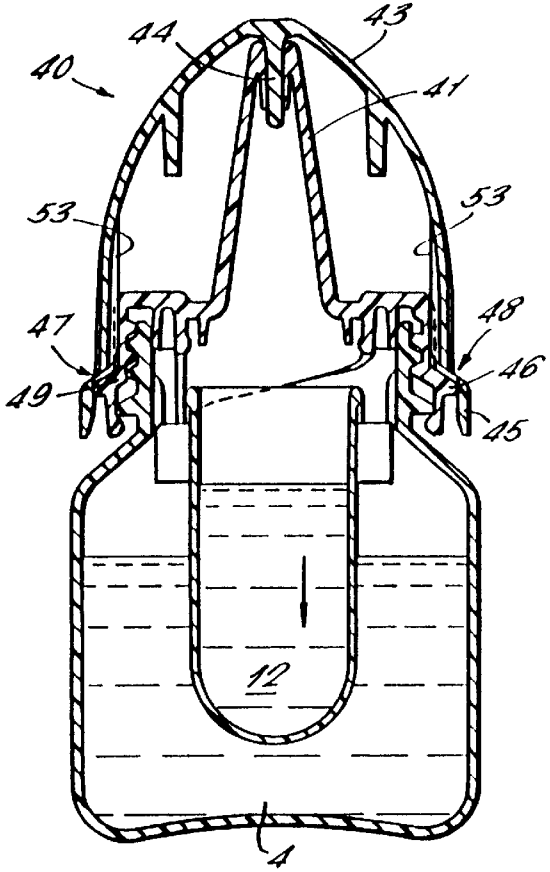
FIG. 10 is a sectioned elevation showing the apparatus of FIG. 9 after rotation of the closure member.
Figure 9:
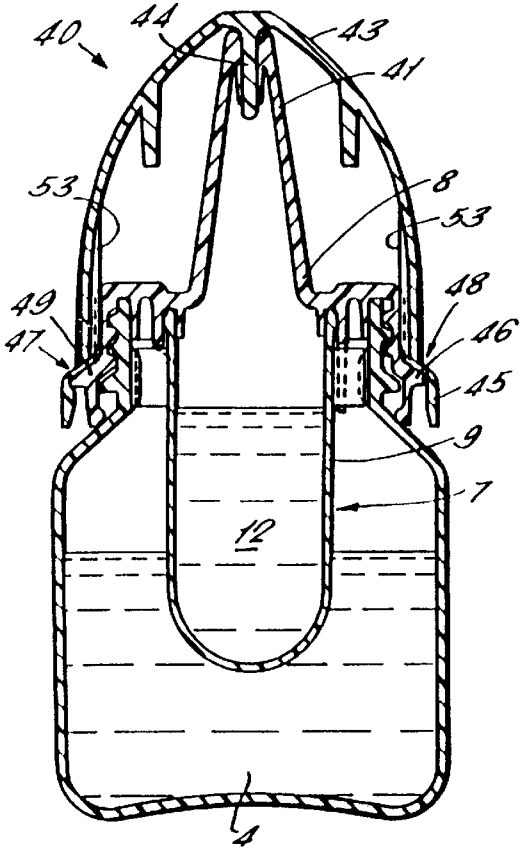
FIG. 9 is a sectioned elevation of the apparatus of FIG. 7 shown on a reduced scale in an initial storage configuration in which first and second components are separately contained.

The closure member 6 is further provided with a cap 43 having a unitarily formed stopper 44 which seals the nozzle opening 42 when the cap is fitted onto the closure member as shown in FIGS. 7, 9 and 10.

The cap 43 is secured to the closure member 6 by means or a circumferential tab 45 which fits over a radially projecting retaining member 46 formed unitarily with the closure member, the tab 45 being provided with an annular zone of weakness 47 defined by an interrupted annular slot 48, thereby facilitating removal of the tab 45 by fracturing the zone of weakness when the user requires to separate the cap from the closure member 6 for the first time.

Figure 8:
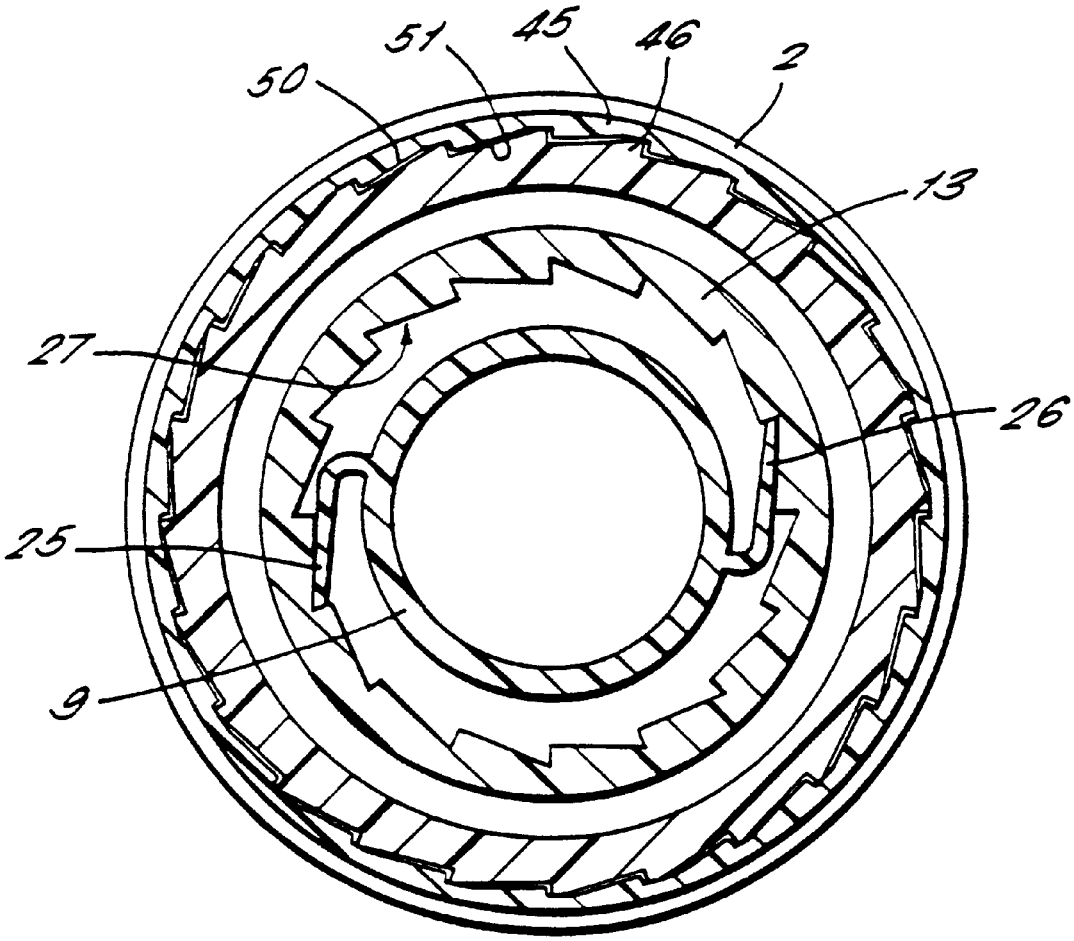
FIG. 8 is a plan view sectioned at VIII—VIII of the apparatus of FIG. 7.

As shown in FIG. 8, the cap 43 is formed separately from a main body 49 of the closure member and the mating surfaces of the tab 45 and main body are provided with ratchet formations 50 and 51 respectively which are arranged to prevent rotation of the tab in a counter clockwise direction relative to the main body 49 when viewed from above in plan as shown in FIG. 8.

The ratchet formations 50 and 51 thereby ensure that the closure member 6 may be unscrewed relative to the neck 13 (in the direction required to actuate vial opening means) by action of a user gripping the cap 43 while the tab 45 remains integral with the cap.

The extent to which the closure member 6 may be unscrewed from the neck 13 is however limited by stop formations constituted by the retaining flange 17 and the retaining rib 18 as described above with reference to the apparatus 1. Once this limit of travel has been reached, the application of further torque to the cap 43 in the counter clockwise direction results in fracture or the zone of weakness 47 thereby separating the cap from the tab 45. The cap 43 is further provided with resilient internal ribs 53 allowing the cap to be retained as a push fit when replaced on the main body 49, the shape of the ribs being shown in FIGS. 13 and 15.

The axial extent of the skirt 16 is sufficient to allow at least 180° of rotational movement of the closure member 6 relative to the neck 13, this being the angular rotation required to actuate the vial opening means, i.e. to effect axial motion of the second portion 9 or the vial sufficient to dissociate the second portion from the first portion 8 in the same manner as described above with reference to the apparatus 1.

Figure 14:
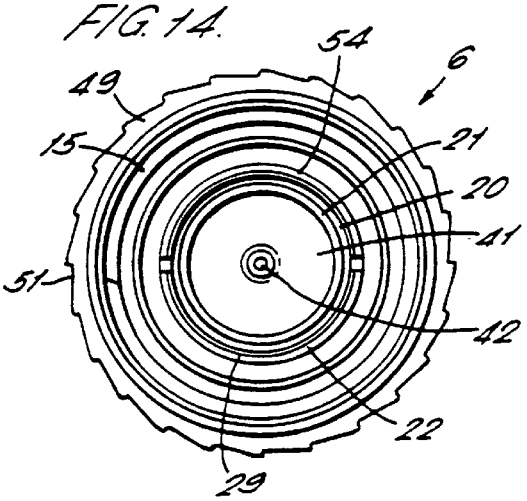
FIG. 14 is an underneath plan view of the closure member of FIG. 12.
Figure 15:
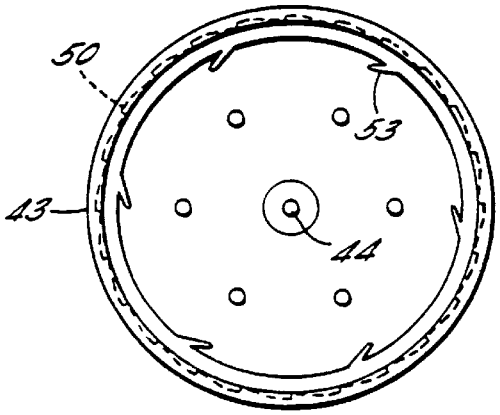
FIG. 15 is an underneath view of the cap of FIG. 13.

The apparatus 40 includes inner and outer tubular members 21 and _2 corresponding to those of the apparatus 1 and defining first and second helical cam surfaces 29 and 54 as shown in FIGS. 12 and 14 and which also correspond to those of the apparatus 1.

The apparatus 40 includes a vial 7 constituted by a first portion 3 formed integrally with the closure member 6 and constituted by nozzle 41 and stopper 44. The vial 7 further includes a second portion 9 which is cylindrical cup shaped and has a rim 24 sealingly received in a groove 23 defined between the inner and outer tubular members 21 and 22.

The outer tubular member 22 defines first and second helical cam surfaces 29 and 54 as shown in FIGS. 12 and 14, the respective cam surfaces each extending slightly less than 180° circumferentially with respect to the outer tubular member 22.

Figure 11:
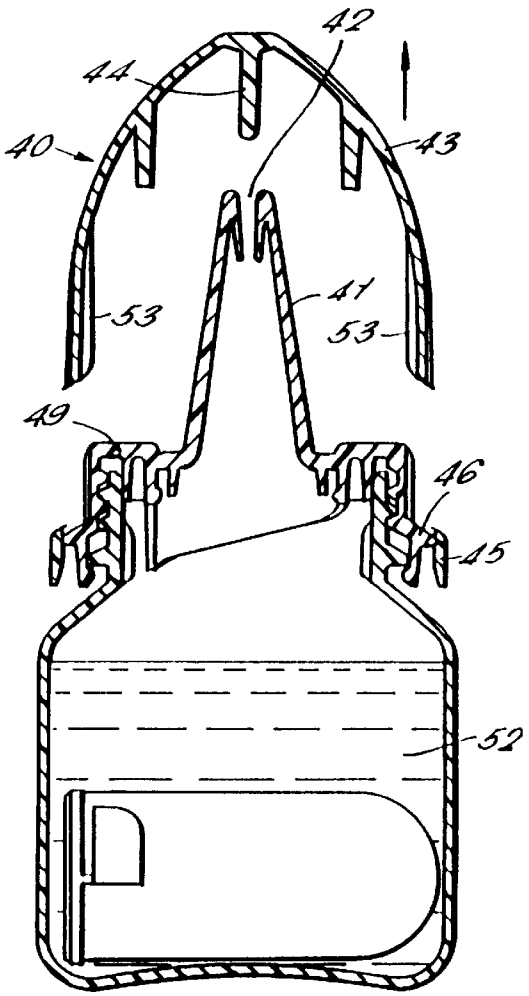
FIG. 11 is a sectioned elevation of the apparatus of FIGS. 9 and 10 after further rotation of the closure member and removal of a cap of the closure member to open a nozzle opening and with a second portion of the vial separated from the closure member.

FIGS. 9, 10 and 11 illustrate the sequence of actions required to allow mixing of the first and second components 4 and 12 prior to dispensing the resulting mixture.

FIG. 9 corresponds to FIG. 7 in showing the first and second portions 3 and 9 of the vial 7 in sealing engagement and with the cap 43 fitted to the main body 49 of the closure member 6, the stopper 44 providing a sealed closure to the nozzle opening 42.

A user wishing to mix and dispense the substance contained in the apparatus 40 rotates the cap 43 relative to the container 2 in a counter clockwise direction as viewed from above into the configuration shown in FIG. 10 where the closure member has been unscrewed relative to the neck 13 to the maximum extent allowed by the presence of the retaining flange 17 and retaining rib 18.

Cam action between the helical cam surfaces 29,54 and the cam members 25, 26 displaces the second portion 9 of the vial downwardly to the extent where it is dissociated from the first portion 8 and falls thereafter to the bottom of the chamber 3 as shown in FIG. 11. In FIG. 11 the cap is also shown to have been removed from the main body 49 of the closure member 6 by fracturing the zone of weakness 47 and axially removing the cap to withdraw the stopper 44 from the nozzle opening 42.

In FIG. 11, the apparatus 40 now contains a mixture 52 of the first and second components 4 and 12 which may be dispensed by inverting the container 2 and squeezing the sides of the container to pressurise and expel the mixture via the nozzle opening 42.

The fracture of the zone of weakness 47 serves as a visual indication that the components have been mixed and that the cap has been removed.

We claim:

1. Apparatus for separately storing and subsequently mixing first and second components of a substance to be dispensed, the apparatus comprising a container defining a chamber for receiving the first component, a closure member rotatably mounted about a tubular neck of the container to close an outlet of the container defined by said neck, a vial comprising a first portion formed integrally with the closure member and a second portion releasably connected in sealing engagement with the first portion to define therebetween a compartment for receiving the second component, and vial opening means comprising co-operating cam formations on the closure member and the second portion of the vial actuatable by co-axial rotational movement of the closure member about the container neck to move the second portion out of sealing engagement with the first portion to thereby establish communication between the chamber and the compartment for mixing of the first and second components, and wherein the cam formations comprise a helical cam surface defined by a projection of the closure member and co-operating cam member of the second portion of the vial, and means are provided on the internal wall of the container and co-operating with the cam member to prevent rotation of the second portion relative to the container during opening such that rotational movement of the closure member displaces the cam member axially in a direction away from the first portion of the vial.

2. The apparatus as claimed in claim 1 wherein the second portion of the vial comprises a hollow cylindrical body and the cam member projects radially therefrom.

3. The apparatus as claimed in claim 1 wherein the cam member is resiliently biased into contact with the rotation preventing means provided by ratchet formations.

4. The apparatus as claimed in claim 1 wherein the cam formations comprise a pair of like cam surfaces diametrically opposed relative to the circumference of the closure member and a co-operating pair of like cam members at locations diametrically opposed relative to the second portion.

5. The apparatus as claimed in claim 1 wherein the closure member is mounted on the neck by co-operating screw formations of the closure member and neck respectively, the screw formations being operable to urge the closure member into sealing engagement with the neck in response to rotation of the closure member relative to the container in a direction which is opposite to the direction of rotation required to actuate the vial opening means.

6. The apparatus as claimed in claim 5 wherein the closure member and the neck comprise respective co-operating stop formations operable to limit the relative rotational movement between the closure member and the container in the direction required to actuate the vial opening means.

7. The apparatus as claimed in claim 6 wherein the stop formations comprise a retaining flange of the closure member co-operating with a retaining rib of the container and wherein the closure member comprises a fracturable zone of weakness whereby at least a portion of the closure member may be selectively removed to facilitate opening of the container by a continued unscrewing action on the closure member.

8. The apparatus as claimed in claim 1 wherein the first portion of the vial is formed unitarily with the closure member.

9. The apparatus as claimed in claim 1 wherein the closure member comprises a dispensing nozzle defining a nozzle opening.

10. The apparatus as claimed in claim 9 wherein the closure member comprises a cap having a stopper sealing fitting into the nozzle opening.

11. A closure member for use in the apparatus as claimed in claim 1.

12. The apparatus as claimed in claim 1 wherein the first portion of said vial and said closure member together form a monolithic unit.

* * * * *